US009751308B2

(12) United States Patent
Lecheheb et al.

(10) Patent No.: US 9,751,308 B2
(45) Date of Patent: Sep. 5, 2017

(54) APPARATUS FOR CONTROLLING INK PRESSURE

(71) Applicant: Tonejet Limited, Royston, Hertfordshire (GB)

(72) Inventors: Ammar Lecheheb, Royston (GB); Ewan Hendrik Conradie, Royston (GB); Jerzy Marcin Zaba, Royston (GB); Ian Philip Butler Ingham, Royston (GB)

(73) Assignee: Tonejet Limited, Royston, Hertfordshire (GB)

( * ) Notice: Subject to any disclaimer, the term of this patent is extended or adjusted under 35 U.S.C. 154(b) by 0 days.

(21) Appl. No.: 15/100,082

(22) PCT Filed: Dec. 5, 2014

(86) PCT No.: PCT/GB2014/053618

§ 371 (c)(1),
(2) Date: May 27, 2016

(87) PCT Pub. No.: WO2015/082933

PCT Pub. Date: Jun. 11, 2015

(65) Prior Publication Data

US 2017/0021618 A1 Jan. 26, 2017

(30) Foreign Application Priority Data

Dec. 5, 2013 (GB) ..... 1321514.0

(51) Int. Cl.
*B41J 2/175* (2006.01)
*B41J 2/14* (2006.01)
*B41J 2/18* (2006.01)

(52) U.S. Cl.
CPC ..... *B41J 2/1433* (2013.01); *B41J 2/175* (2013.01); *B41J 2/18* (2013.01)

(58) Field of Classification Search
CPC ..... B41J 2/1433; B41J 2/18; B41J 2/175
See application file for complete search history.

(56) References Cited

U.S. PATENT DOCUMENTS 8,322,832 B2 * 12/2012 Emerton ..... B41J 2/17509 347/84
2011/0128334 A1 6/2011 Akiyama et al.
(Continued)

FOREIGN PATENT DOCUMENTS

EP 1092548 A2 4/2001
EP 1366901 A1 12/2003
(Continued)

OTHER PUBLICATIONS

International Search Report dated Feb. 16, 2015, issued in PCT Application No. PCT/GB2014/053618.
(Continued)

*Primary Examiner* — Geoffrey Mruk
(74) *Attorney, Agent, or Firm* — Dickinson Wright PLLC

(57) ABSTRACT

An apparatus for controlling ink pressure in a printhead, the apparatus comprising: an integrally formed structure having: at least one control reservoir separated into first and second chambers by a weir; at least one inlet passageway, extending from the first chamber to an inlet port on an edge of the structure, for supplying ink from a remote source into the first chamber of the reservoir; at least one fluid outlet passageway, extending from the second chamber to an outlet port on an edge of the structure, for recirculating fluid from the reservoir to the remote source of ink; and at least one ink supply port, in communication with the first chamber, for supplying ink to, or receiving ink from, a printhead.

20 Claims, 4 Drawing Sheets

(56) References Cited

U.S. PATENT DOCUMENTS

| | | | |
|---|---|---|---|
| 2012/0026255 | A1 | 2/2012 | Park |
| 2012/0098898 | A1 | 4/2012 | Park et al. |

FOREIGN PATENT DOCUMENTS

| | | | |
|---|---|---|---|
| EP | 1224079 | | 6/2013 |
| JP | 11-268289 | | 10/1999 |
| JP | H2011268289 | A | 10/1999 |
| JP | 2011-230337 | | 11/2011 |
| JP | H2011230337 | A | 11/2011 |
| WO | WO 97/44194 | | 11/1997 |
| WO | WO 2006/030235 | A2 | 3/2006 |
| WO | WO 2008/035120 | A1 | 3/2008 |
| WO | WO 2009/077790 | A1 | 6/2009 |
| WO | WO 2010/118225 | A1 | 10/2010 |
| WO | WO 2012/137523 | A1 | 10/2012 |

OTHER PUBLICATIONS

GB Search Report dated Jun. 6, 2014 issued in corresponding Application No. GB1321514.0.

* cited by examiner

APPARATUS FOR CONTROLLING INK PRESSURE

FIELD OF THE INVENTION

The present invention relates to an apparatus for use in or with an inkjet printer. In particular the present invention relates to an apparatus that enables the pressure of the supplied ink to be varied in order to prime a printhead and in which the supply of ink can be provided at a controlled pressure to the ink ejection location. Importantly, the invention relates to an apparatus that can supply ink from a plurality of reservoirs.

BACKGROUND

In an inkjet printer, in order to achieve consistent ejection of ink from the printhead, precise control of the static pressure of ink is required at the ejection location. In a printhead such as described in EP 1224079 and EP 1366901 precise control of the ink flow is also required. Experience has shown that the pressures at the printhead described in EP 1224079 and EP 1366901 need to be correct to about ±20 Pa and those periodic variations must be below about ±2 Pa to eliminate visible variations in print quality.

A simple method of controlling the pressure of the ink supplied to a printhead is to use gravity. An ink reservoir, whereby the surface of the ink is open to atmospheric pressure, is mounted either above or below the level of the printhead in order to generate a positive or negative ink pressure, as required by the printhead. The required inlet pressure at the ejection location can be set by mechanically adjusting the relative height of the ink reservoir with respect to the printhead. The reservoir may also be supplied with ink by a pump.

Some inkjet printers require ink to flow continuously through the printhead and this requires the printhead to have both an inlet and an outlet to allow ink to flow in and out of the printhead. In these printers the pressure of the ink at this outlet can also be controlled by gravity by allowing ink to flow to atmospheric pressure from the outlet tube to a defined level below the printhead. This level can also be mechanically adjusted to achieve the correct operating conditions (such as ink pressure and flow rate) at the ejection location.

Known disadvantages of a gravity-fed system are:

- Changing the pressures requires physical movement of the reservoirs.
- The location of the reservoirs is determined by the required pressures.
- A large volume of space may be required to accommodate the total adjustable range of the reservoirs.
- Priming printheads with ink can be assisted by supplying ink at pressures that are very different from the pressures required during printing. With a gravity-fed system a large amount of space and typically a significant amount of time is required to move the reservoirs to achieve these pressures.
- The surface of the ink must be open to the atmosphere, increasing the risk of dust or other contaminants polluting the ink.

WO 97/44194 and EP 1092548 describe ink supply systems in which the ink is maintained at a constant level or height in the reservoir by use of a weir; however, these systems all use gravity to set the pressure at the ejection location.

WO 2006/030235 describes a system where the pressure of the ink at the inlet and outlet of a nozzle containing fluid supply apparatus is controlled by controlling the pressure of the air above a weir at the inlet and the outlet from the nozzle containing fluid supply apparatus. In order to maintain the functioning of the weir it is necessary to remove the ink that has flowed over the weir from the reservoir.

WO 2006/030235 describes how this can be done by allowing the ink to be sucked back to the main ink tank through a flow restriction by lowering the pressure of the ink in the main ink tank. However, the rate at which ink is drawn from the reservoirs into the main ink tank will depend on the position of the ink tank relative to the reservoirs, which will require the amount of restriction to be compensated to account for this. In addition, the rate at which ink is drawn from the reservoirs into the main ink tank will depend on whether gas or ink is passing through the flow restriction at any particular moment. This fluctuation in flow rate will tend to lead to fluctuations in the pressure in the reservoir unless the pressure is controlled very carefully with a control system with a very short response time.

In order to avoid this problem a method using floats is presented in WO 2006/030235. The height of these floats is monitored using sensors, thus avoiding the over flow from being drained insufficiently quickly or air being withdrawn. However including floats and sensors increases the cost of the system and can introduce additional failure mechanisms.

WO 2008/035120 discloses an ink management system for supplying or receiving liquid at a controlled pressure comprising a closed reservoir, a weir disposed in the reservoir and configured to separate the reservoir into a first and a second chamber, the first chamber having an inlet for receiving liquid from a first remote location, and the weir being disposed such that the level of liquid in the first chamber can be maintained at a constant height, wherein the reservoir is sealed from the surrounding atmosphere and the system further comprises a pumped outlet disposed in the second chamber and arranged to remove liquid and gas contained within the reservoir.

The advantage of having a reservoir with a weir that is independent of the surrounding atmosphere is that the pressure of the ink can be controlled by adjusting the pressure of the gas over the surface of the ink without having to adjust the height of the reservoir or weir. Controlling the pressure of the gas may involve a pressure sensor, an actuator and some control electronics arranged in an active feedback loop to control the pressure.

The ink pressure control apparatus close to the printhead (often called a Local Ink Feed, or LIF) has to control ink pressure accurately and reliably for the printhead to function correctly.

Typically, known LIFs are assembled from discrete components supported on a metal chassis, interconnected with flexible tubing to carry ink, rinse fluid and air between the components. To facilitate connection, components are typically fitted with barbed tube connectors or mounted on manifold blocks as appropriate, adding to the component count. The large number of components and connectors, together with the constraints on their relative positions from fluid flow considerations, results in a complex assembly that is expensive to manufacture, difficult to assemble and service. It is also heavy and large, forcing the local ink feed to be located separately from the printhead whose pressure it regulates, resulting in inaccurate pressure control at the printhead caused by pressure drops in the connecting tubes. The large size of the LIF also causes the printer equipment to be undesirably large. A further problem is that fluid connectors are prone to trap air bubbles leading to unreliable ink flow to the printhead.

The present invention aims to overcome one or more of the problems identified above, namely to produce a pressure control apparatus with increased reliability, to create an apparatus that is compact, lightweight, and which can, preferably, be integrated with the printhead itself, and to produce an apparatus which is much lower cost and is very simple to assemble.

According to the present invention, there is provided an apparatus for controlling ink pressure in a printhead, the apparatus comprising an integrally formed structure having at least one control reservoir separated into first and second chambers by a weir, at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink; and at least one ink connection passageway, extending from the first chamber to an ink supply port, for supplying ink to, or receiving ink from, a printhead.

According to a further embodiment of the present invention, there is provided an apparatus for controlling ink pressure in a printhead, the apparatus comprising an integrally formed structure having at least one control reservoir separated into first and second chambers by a weir, at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink; and at least one ink supply port, in communication with the first chamber, for supplying ink to, or receiving ink from, a printhead.

Thus the present invention overcomes the reliability issues by integrating the LIF into a single component, thereby eliminating internal flexible tubing and connectors and reducing the lengths of interconnections making it considerably more reliable. The elements of the LIF can be arranged in much closer proximity with each other because there is no requirement for access to interconnections for assembly and servicing, so the resultant LIF is much smaller allowing much closer proximity with the printhead itself.

The apparatus preferably comprises at least one ink connection passageway, extending from the first chamber to the at least one ink supply port.

The structure is preferably formed by an additive manufacturing process, such as stereolithography. By manufacturing the structure by an additive process such as, stereolithography, this enables re-entrant features and blind passageways to be created simply and inexpensively inside a single component, typically made of made of lightweight resin.

Each reservoir may have a dedicated inlet passageway and/or a dedicated fluid outlet passageway.

A pressure control system may be provided having a further passageway, extending from the reservoir to a pressure port on the edge of the structure, for sensing the air pressure within the reservoir.

The pressure sensing passageway preferably includes an air chamber. The air chamber preferably includes one or more baffles. The baffles may be angled such that, in use, fluid between the baffles and the pressure port drains back into the reservoir. The use of the air chamber and/or the use of the baffles preferably directly above the control reservoirs stop fluid ingress into the pressure sensor during LIF cleaning operations. A pressure sensor may be connected to or retained within the pressure port.

The apparatus may further comprise a pressure control passage extending from a part of the pressure sensing passageway to a pressure control port on the edge of the structure. The pressure control passageway preferably extends from the air chamber to the pressure control port. Co-location of the pressure sensing elements and pressure control elements, typically at the top of the apparatus, again means that the component count can be reduced, as no pressure isolation valves are required. This further reduces the complexity of the apparatus and reduces the component count.

The pressure sensing elements are typically designed to work with air pressure and it is important to prevent ink and/or rinse fluid from coming into contact with the sensing elements. Previous methods have employed an isolation valve that is closed during automated cleaning operations that introduce rinse under pressure into the control reservoir. However, the co-location of the pressure sensing elements and pressure control elements means that during cleaning operations, the rinse is prevented from reaching the sensor by closing the orifice valve (pressure control element), thereby causing air in the air chamber to pressurise and prevent rinse from entering the air chamber, keeping the sensor dry. This eliminates the need for an isolation valve to be placed between the chamber and the sensor.

Each reservoir preferably has its own dedicated pressure control system.

The apparatus may further comprise one or more passageways for allowing rinse fluid and/or air to flow through the structure for supply to a printhead. Preferably at least one rinse passageway and at least one air passageway are provided. At least one of the rinse and one of the air passageways may merge to form a combined flow. One or more of the rinse passageways may exit into an air passageway. There may be one rinse passageway per air passageway or more than one rinse passage may exit into any given air passageway.

An inkjet printer may be provided including an apparatus according to the invention wherein one reservoir supplies liquid to a printhead and the other reservoir receives liquid from the printhead, thereby controlling the pressure of the liquid supplied to the printhead and the pressure of the liquid removed from the printhead, such that the ink flows through the printhead at a controlled rate and at a controlled pressure.

Alternatively, the plurality or reservoirs may supply different inks to a printhead or plurality of printheads, which may further be supplied with one ink or a plurality of inks, for example, cyan, magenta, yellow and black inks.

The integrally formed structure may be a single structure containing two or more reservoirs, each reservoir having at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink, and at least one ink connection passageway, extending from the first chamber to an ink supply port, for supplying ink to, or receiving ink from, a printhead.

The integrally formed structure may be a single structure containing two or more reservoirs, each reservoir having at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink, and at least one ink supply port, in communication with the first chamber, for supplying ink to, or receiving ink from, a printhead.

Each reservoir may have at least one ink connection passageway extending from the first chamber to the at least one ink supply port.

The apparatus may include one or more additional integrally formed structures, each having at least one control reservoir separated into first and second chambers by a weir, at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink; and at least one ink connection passageway, extending from the first chamber to an ink supply port, for supplying ink to, or receiving ink from, a printhead.

The apparatus may include one or more additional integrally formed structures, each having at least one control reservoir separated into first and second chambers by a weir, at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink; and at least one ink supply port, in communication with the first chamber, for supplying ink to, or receiving ink from, a printhead.

Each additional integrally formed structure may further have at least one ink connection passageway extending from the first chamber to the at least one ink supply port.

One or more of the additional integrally formed structures may contain two or more reservoirs, each reservoir having at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink, and at least one ink connection passageway, extending from the first chamber to an ink supply port, for supplying ink to, or receiving ink from, a printhead.

One or more of the additional integrally formed structures may contain two or more reservoirs, each reservoir having at least one inlet passageway, extending from the first chamber to an inlet port on an edge of the structure, for supplying ink from a remote source into the first chamber of the reservoir, at least one fluid outlet passageway, extending from the second chamber to an outlet port on an edge of the structure, for recirculating fluid from the reservoir to the remote source of ink, and at least one ink supply port, in communication with the first chamber, for supplying ink to, or receiving ink from, a printhead.

Each reservoir may further have at least one ink connection passageway extending from the first chamber to the at least one ink supply port.

BRIEF DESCRIPTION OF THE FIGURES

An example of the system of the present invention will now be described with reference to the accompanying drawings, in which.

DETAILED DESCRIPTION

Figure 1:
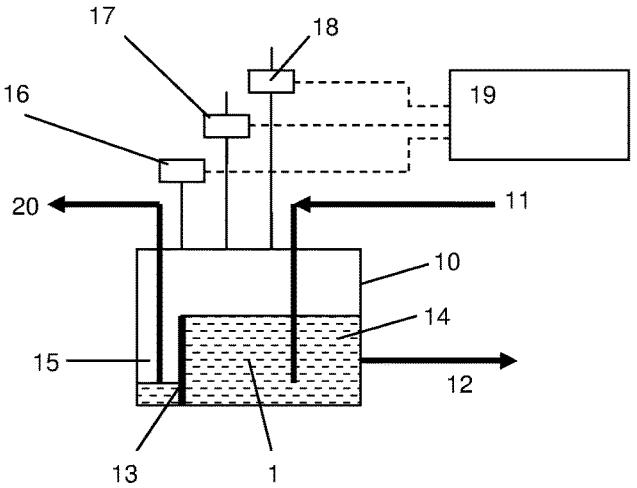
FIG. 1 is a schematic view of a known system.

FIG. 1 shows an ink reservoir 10 which is supplied with ink 1 from a remote location (not shown) through an inlet pipe 11. Ink exits the bottom of the reservoir via an outlet pipe 12 to a printhead (not shown). Disposed in the reservoir 10 is a weir 13 which separates the reservoir into a first chamber 14 and a second chamber 15. Ink is pumped into the first chamber 14 through the inlet pipe 11 until it reaches the height of the top of weir 13 at which point it flows over the weir 13 into the second chamber 15. The fixed height of the weir fixes the volume of ink in the first reservoir and the vertical displacement between the surface of the ink and the printhead ejection location. Ink is removed from the second chamber 15 by pumping the ink through an overflow return line 20. The overflow return line is configured to pump both ink and gas from the second chamber 15.

The air pressure in the reservoir 10 above the surface of the ink 1 is also controlled and can be measured by a pressure sensor 16. Air can be either bled into or out of the reservoir 10 through an air bleed valve 17 (which can be supplied with air at any given pressure) or it can be pumped in or out of the reservoir by a pump 18 to maintain the pressure in the reservoir at a set point. The air pressure above the surface of the ink 1 in the reservoir 10 can be controlled and set at a desired set point by control electronics 19, or programmed via a computer (not shown). Although air is described in this example, any other suitable gas may be used.

The reservoir 10 can also be configured such that the pump 18 is not required to control the air pressure above the surface of the ink. In this example, the rate of pumping on the overflow return line 20 is greater than the rate at which ink is supplied into the second chamber 15 of the reservoir 10 as it flows over the weir 13. Therefore, both ink and air will always be pumped out of the reservoir 10. This will reduce the pressure of the air in the reservoir 10. The pressure in the reservoir 10 can then be controlled by bleeding air through the air bleed valve 17 into the reservoir 10 in order to maintain the pressure at the desired set point. This example, without the pump 18, results in a system which is less complex since it has fewer parts and will therefore be more reliable.

Owing to the design of the reservoir 10, the ink in the reservoir is kept in constant motion which causes gentle agitation within the ink that some systems require to maintain good dispersion of insoluble materials in the ink, such as pigments.

The control of the air pressure in the reservoir 10 allows the reservoir to be mounted close to the printhead, eliminating the need for long lengths of tubing. This results in a more compact print system that could also be scanned along with a scanning printhead, for example.

In some inkjet systems, a single reservoir (as shown) is sufficient; however, other systems require ink to flow around the printhead and for this two reservoirs are required. In a gravity-fed, two-reservoir system, one reservoir receives ink from the printhead and needs to be placed at a level below the ejection location and one reservoir supplies ink to the printhead and needs to be placed at a level above the other reservoir. In the system of the invention, both reservoirs can be set at the desired pressures by changing the pressure of the gas in the reservoir regardless of their location. Therefore, it is not necessary to maintain the two reservoirs at precise heights relative to the printhead. Furthermore, in the two-reservoir system, the flow through the printhead can be reversed easily by adjusting the pressures within each reservoir.

In a particular example, the reservoir is used to feed ink to a printhead at a pressure of −50 Pa. The reservoir is mounted approximately 150 mm above the printhead and the air pressure in the reservoir is approximately −1550 Pa relative to atmospheric pressure. Ink is pumped into the inlet reservoir at 25 ml per min and ink and air are pumped from the overflow at 30 ml per min. Ink flows from the reservoir into the printhead at around 20 ml/min. The pressure in the chamber is monitored and the flow of air into the chamber is controlled with an electronically controlled orifice to maintain the desired pressure. The measurement frequency of the control circuitry is 10 kHz and the actual response time is better than 10 ms, allowing the pulses from the ink supply and ink overflow pumps to be smoothed out to within ±5 Pa. The volume of ink within the reservoir at any one moment is 1.8 ml, and the volume of air is 2.4 ml.

Figure 2:
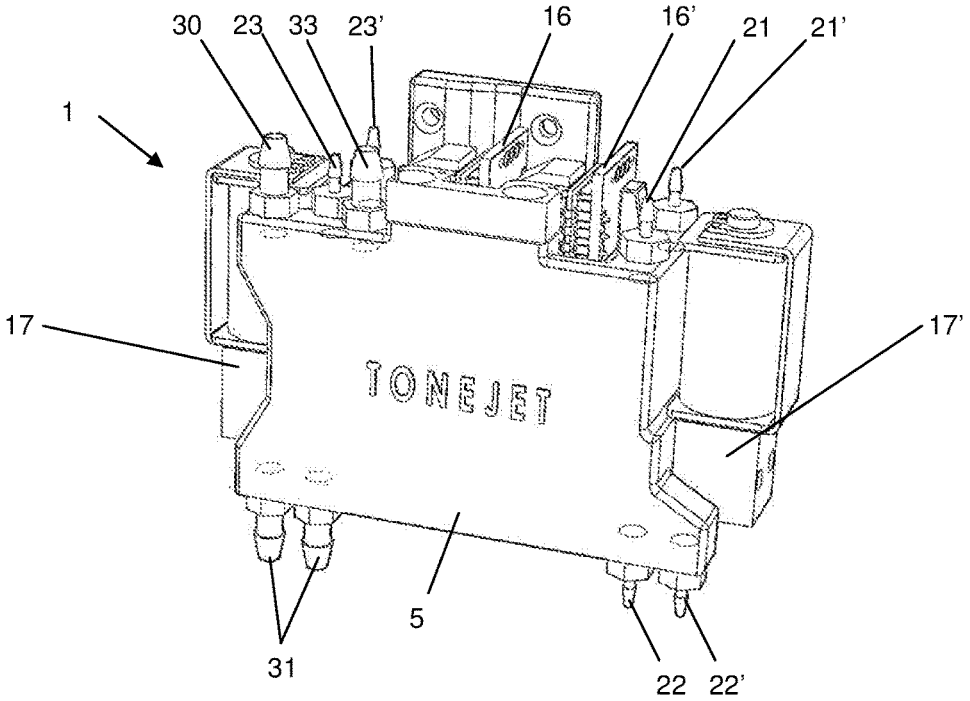
FIG. 2 is a perspective view from the front and one side of one example of the present invention.
Figure 3:
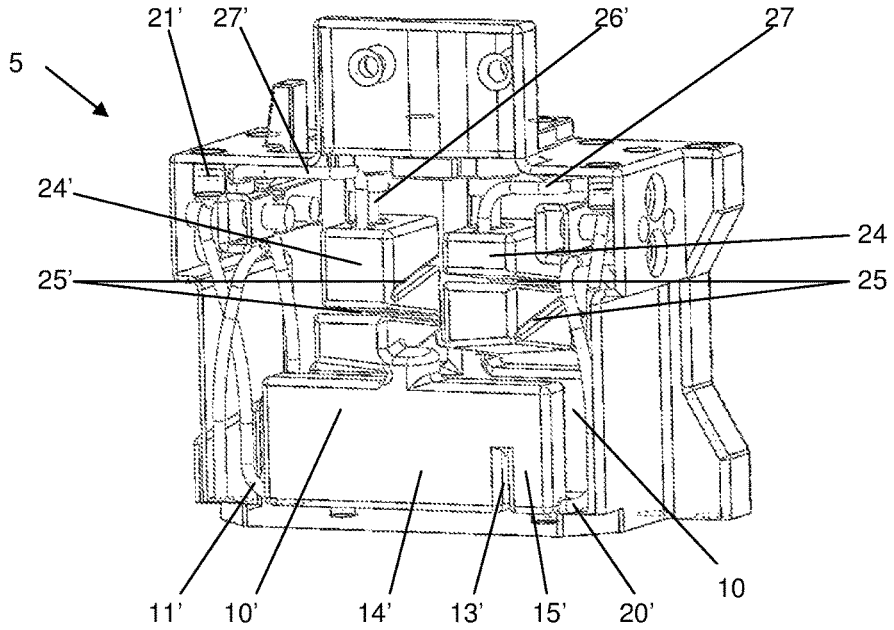
FIG. 3 shows a partial internal view of the apparatus of FIG. 2 from the rear.
Figure 4:
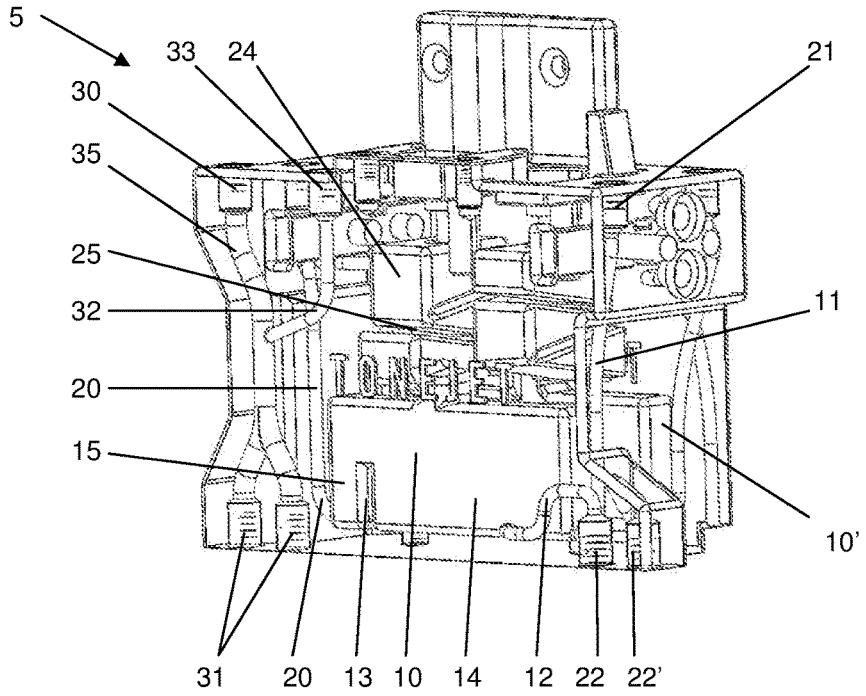
FIG. 4 is a partial internal view of the apparatus of FIG. 2 from the front.

The present invention is shown in FIGS. 2 to 4. In this example of the invention, multiple reservoirs are formed in a single integrally formed structure. The multiple reservoirs may be a plurality of supply reservoirs, a plurality of receiving reservoirs (i.e. those that receive ink from the printhead), or a mixture of supply and receiving reservoirs.

FIGS. 2 to 4 show an apparatus 1, commonly referred to as an integrated local ink feed (LIF) having an integrally formed structure 5 in which various components described below are integrally formed. In particular, FIGS. 3 and 4 show two reservoirs 10, 10', each of which is designed in line with the arrangement of FIG. 1. Thus, each reservoir 10 contains a weir 13 of fixed height separating the respective reservoir into a first chamber 14 and a second chamber 15.

Each reservoir additionally has:

an inlet passageway 11 into the first chamber that feeds it with ink from a remote source of ink (not shown) via a tube connected to an inlet port 21 on the upper surface of the LIF.

an outlet passageway 20 from the second chamber to a return port 23 through which ink and air may be pumped from the second chamber back to the remote source of ink.

a passageway that connects the top of the reservoir to a port 26 to which a pressure sensor 16 is fitted to measure the pressure of air above the level of ink in the reservoir. The passageway includes, in this example, an air chamber 24 subdivided by baffles 25 (one or more baffles may be used). The baffles serve to prevent fluid from reaching the pressure sensors 16, especially during modes of operation where the LIF is flushed with cleaning "rinse" fluid, which could detrimentally affect the operation of the pressure sensors. The baffles 25 are angled to allow any fluid to drain from them back into the reservoir. This eliminates the need in earlier designs for an isolation valve placed between the reservoir 10 and the pressure sensor 16.

a passageway 27 that leads from the top of said baffled air chamber adjacent to the port 26 is also connected to a port for the connection of a proportional valve 17 (i.e. an electrically controlled orifice) which is controllable to allow air to flow into or out of the reservoir from/to the surrounding atmosphere. The co-location of the connections from the air chamber 24 to the valve 17 and the pressure sensor 16 further reduces the chance of fluid reaching the pressure sensor during the aforementioned cleaning operation, by arranging that the valve 17 is set to its closed position whereby the action of fluid attempting to rise through the baffled chamber 24 will pressurise the air in the chamber 24, preventing the fluid from rising far enough to reach the sensor 16.

a printhead connection (ink supply or return) port 22, in communication with the first chamber, for supplying ink to, or receiving ink from, a printhead. The ink supply port may be directly connected to the first chamber. For example, the printhead connection (ink supply or return) port 22 may be disposed on the first chamber (not shown), for example, at the base of the first chamber. Alternatively, there may be provided an ink connection passageway 12 connecting the base of the first chamber with the printhead connection (ink supply or return) port 22.

The LIF 1 additionally includes an arrangement of internal passageways used to mix a supply of rinse fluid with air for cleaning the printhead. This comprises an air path 35 from air inlet port 30 to outlet ports 31 into which is branched a rinse supply passage 32 that injects rinse from a rinse inlet port 33 into the flow of air in the said air path.

The functional elements of the LIF for one head as described above can easily be replicated within a single SLA component to serve a number of printheads, e.g. a CMYK set of 4 printheads.

Figure 5:
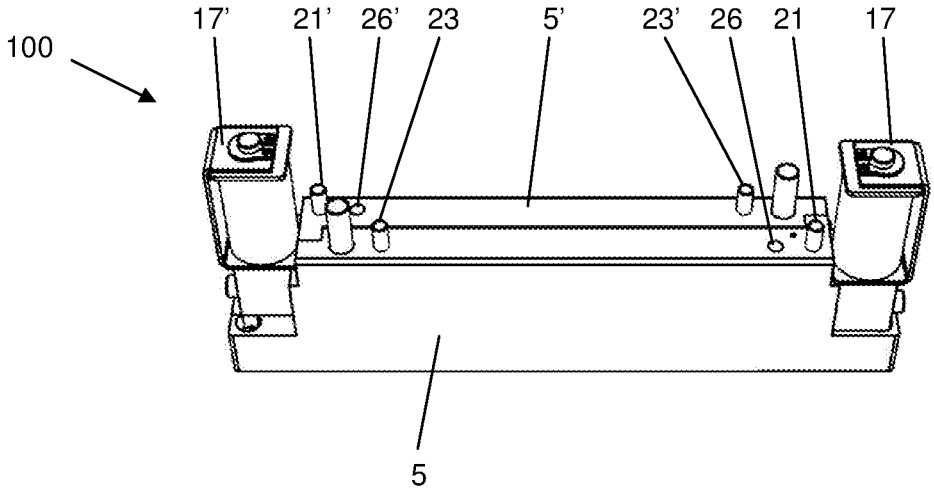
FIG. 5 is a schematic perspective view of another example of the present invention.
Figure 6:
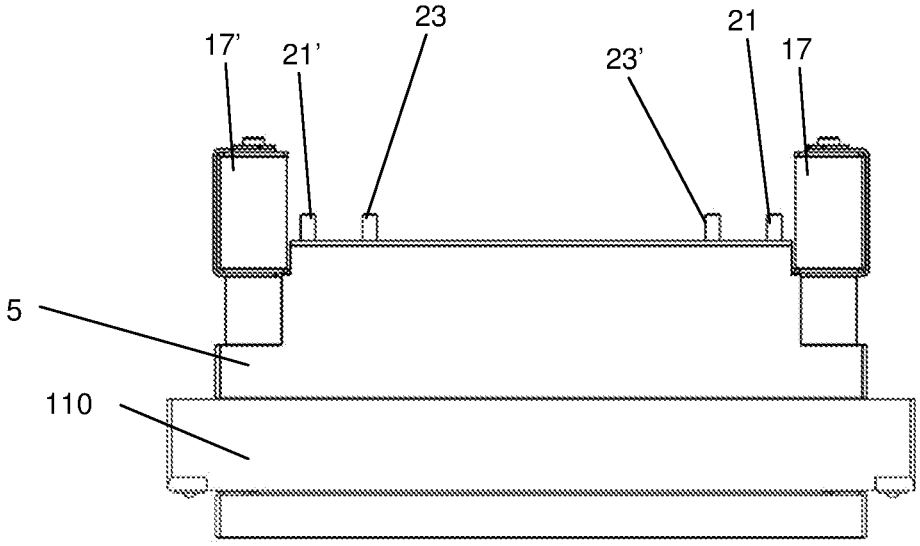
FIG. 6 is an elevation view of the example of FIG. 5 connected to a printhead.

A further example of the invention is shown in FIGS. 5 and 6, in which an apparatus 100 (a LIF) has separate integrally formed structures 5, 5'. In this example, each structure 5, 5' has a single reservoir of the type described above with respect to FIG. 1, but with the integrated passageways and ports as described with respect to FIGS. 2 to 4. Such an arrangement benefits from the same advantages, such as overcoming the reliability issues by eliminating internal flexible tubing and connectors and reducing the lengths of interconnections. The various internal elements can be arranged in much closer proximity with each other because there is no requirement for access to interconnections for assembly and servicing, so the resultant apparatus is much smaller allowing much closer proximity with the printhead 110 itself.

One of the reasons for this configuration is that certain devices may require flexible circuits to emerge from the back of the printhead 110 to connect to the drive electronics through the region occupied by the LIF. This forces the LIF 1 to be in two halves 5,5', one on each side of the emerging flexible circuits, with each of the two halves having at least one of the reservoirs.

Thus, the structures are typically mounted on the printhead in pairs, and whilst only two structures are shown, it is envisaged that multiple pairs could be provided, typically if multiple printheads were used.

Whilst FIGS. 5 and 6 show separate structures, each containing a single reservoir, it is envisaged that the separate structures could include multiple reservoirs, such as the arrangement of FIGS. 2 to 4.

The invention claimed is:

1. An apparatus (1) for controlling ink pressure in a printhead, the apparatus comprising:

an integrally formed structure (5) having:

at least one control reservoir (10, 10') separated into first (14, 14') and second (15, 15') chambers by a weir (13, 13');

at least one inlet passageway (11, 11'), extending from the first chamber (14, 14') to an inlet port (21, 21') on an edge of the structure (5), for supplying ink from a remote source into the first chamber (14, 14') of the reservoir (10, 10');

at least one fluid outlet passageway (20, 20'), extending from the second chamber (15, 15') to an outlet port (23, 23') on an edge of the structure (5), for recirculating fluid from the reservoir (10, 10') to the remote source of ink;

at least one ink supply port (22, 22'), in communication with the first chamber (14, 14'), for supplying ink to, or receiving ink from, a printhead; and a pressure control system having a pressure sensing passageway, extending from the reservoir (10, 10') to a pressure port (26, 26') on the edge of the structure (5), for sensing the air pressure within the reservoir (10, 10'), wherein the pressure sensing passageway includes an air chamber (24, 24'), wherein the air chamber (24, 24') includes one or more baffles (25, 25').

2. An apparatus according to claim 1, further comprising at least one ink connection passageway extending from the first chamber to the at least one ink supply port.

3. An apparatus according to claim 1, wherein the structure is formed by an additive manufacturing process.

4. An apparatus according to claim 3, wherein the additive manufacturing process is stereolithography.

5. An apparatus according to claim 1, wherein each reservoir has a dedicated inlet passageway and/or a dedicated fluid outlet passageway.

6. An apparatus according to claim 1, wherein the baffles are angled such that, in use, fluid between the baffles and the pressure port drains back into the reservoir.

7. An apparatus according to claim 1, further comprising a pressure sensor connected to or retained within the pressure port.

8. An apparatus according to claim 1, further comprising a pressure control passage extending from a part of the pressure sensing passageway to a pressure control port on the edge of the structure.

9. An apparatus according to claim 8, wherein the pressure control passageway extends from the air chamber to the pressure control port.

10. An apparatus according to claim 1, wherein each reservoir has a dedicated pressure control system.

11. An apparatus according to claim 1, further comprising one or more passageways for allowing rinse fluid and/or air to flow through the structure for supply to a printhead.

12. An apparatus according to claim 11, further comprising at least one rinse passageway and at least one air passageway.

13. An apparatus according to claim 12, wherein at least one of the rinse and one of the air passageways merge to form a combined flow.

14. An apparatus according to claim 12, wherein a rinse passageway exits into an air passageway.

15. An apparatus according to claim 1, wherein the integrally formed structure is a single structure containing two or more reservoirs, each reservoir having:

at least one inlet passageway, extending from the first chamber to an inlet port on an edge of the structure, for supplying ink from a remote source into the first chamber of the reservoir;

at least one fluid outlet passageway, extending from the second chamber to an outlet port on an edge of the structure, for recirculating fluid from the reservoir to the remote source of ink; and at least one ink supply port, in communication with the first chamber, for supplying ink to, or receiving ink from, a printhead.

16. An apparatus according to claim 15, each reservoir further having at least one ink connection passageway extending from the first chamber to the at least one ink supply port.

17. An apparatus according to claim 1, wherein the apparatus includes one or more additional integrally formed structures, each having:

at least one control reservoir separated into first and second chambers by a weir;

at least one inlet passageway, extending from the first chamber to an inlet port on an edge of the structure, for supplying ink from a remote source into the first chamber of the reservoir;

at least one fluid outlet passageway, extending from the second chamber to an outlet port on an edge of the structure, for recirculating fluid from the reservoir to the remote source of ink; and at least one ink supply port, in communication with the first chamber, for supplying ink to, or receiving ink from, a printhead.

18. An apparatus according to claim 17, each additional integrally formed structure further having at least one ink connection passageway extending from the first chamber to the at least one ink supply port.

19. An apparatus according to claim 17, wherein one or more of the additional integrally formed structures contains two or more reservoirs, each reservoir having:

at least one inlet passageway, extending from the first chamber to an inlet port on an edge of the structure, for supplying ink from a remote source into the first chamber of the reservoir;

at least one fluid outlet passageway, extending from the second chamber to an outlet port on an edge of the structure, for recirculating fluid from the reservoir to the remote source of ink; and at least one ink supply port, in communication with the first chamber, for supplying ink to, or receiving ink from, a printhead.

20. An apparatus according to claim 19, each reservoir further having at least one ink connection passageway extending from the first chamber to the at least one ink supply port.

* * * * *